US005502968A

United States Patent [19]

Beale

[11] Patent Number: 5,502,968

[45] Date of Patent: Apr. 2, 1996

[54] FREE PISTON STIRLING MACHINE HAVING A CONTROLLABLY SWITCHABLE WORK TRANSMITTING LINKAGE BETWEEN DISPLACER AND PISTON

[75] Inventor: William T. Beale, Athens, Ohio

[73] Assignee: Sunpower, Inc., Athens, Ohio

[21] Appl. No.: 349,947

[22] Filed: Dec. 6, 1994

Related U.S. Application Data

[63] Continuation-in-part of Ser. No. 932,686, Aug. 20, 1992, Pat. No. 5,385,021.

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,991,586 | 11/1976 | Acord | 62/6 |
| 4,350,012 | 9/1982 | Folsom et al. | 62/6 |
| 4,610,143 | 9/1986 | Stolfi et al. | 62/6 |
| 4,783,968 | 11/1988 | Higham et al. | 62/6 |
| 4,819,439 | 4/1989 | Higham et al. | 62/6 |
| 4,822,390 | 4/1989 | Kazumoto et al. | 62/6 |
| 4,872,313 | 10/1989 | Kazumoto et al. | 62/6 |
| 4,912,929 | 4/1990 | Chen et al. | 62/6 |
| 5,022,229 | 6/1991 | Vitale | 62/6 |
| 5,032,772 | 7/1991 | Gully et al. | 62/6 |
| 5,088,288 | 2/1992 | Katagishi et al. | 62/6 |
| 5,090,206 | 2/1992 | Strasser | 62/6 |
| 5,113,662 | 5/1992 | Fujii et al. | 62/6 |
| 5,177,971 | 1/1993 | Kiyota | 62/6 |

*Primary Examiner*—Ronald C. Capossela

*Attorney, Agent, or Firm*—Frank H. Foster; Kremblas, Foster & Millard

[57] ABSTRACT

Free piston Stirling coolers and engines are improved by a variable power transmitting linkage connecting the displacer to the piston and coupling more power from the displacer to the piston while piston displacement exceeds a selected limit than coupled while piston displacement is less than the selected limit. Adjustment of the position of the limit is used to control stroke amplitude, power output or thermal pumping rate.

21 Claims, 7 Drawing Sheets

FIG-4
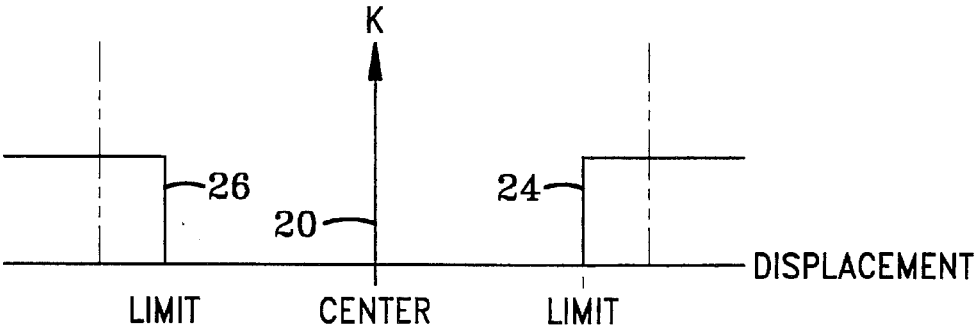
FIG-5
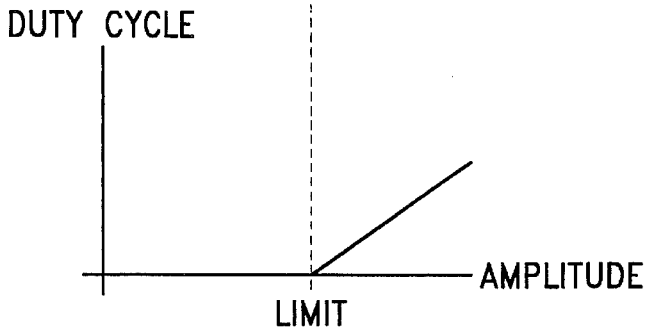
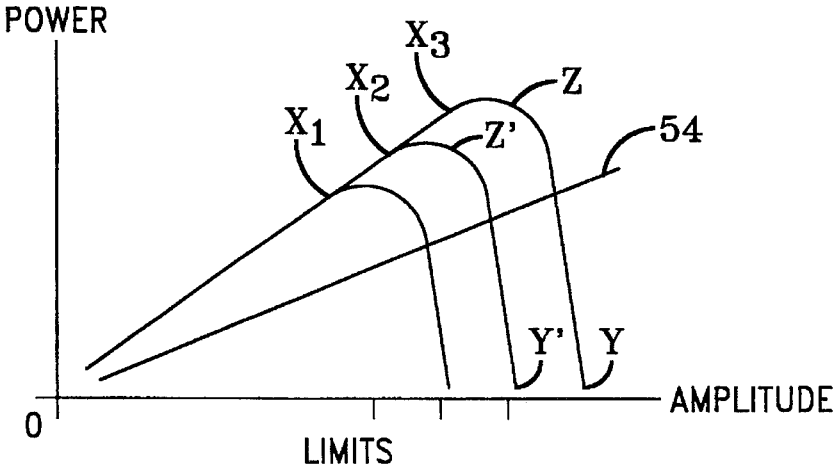
FIG-6

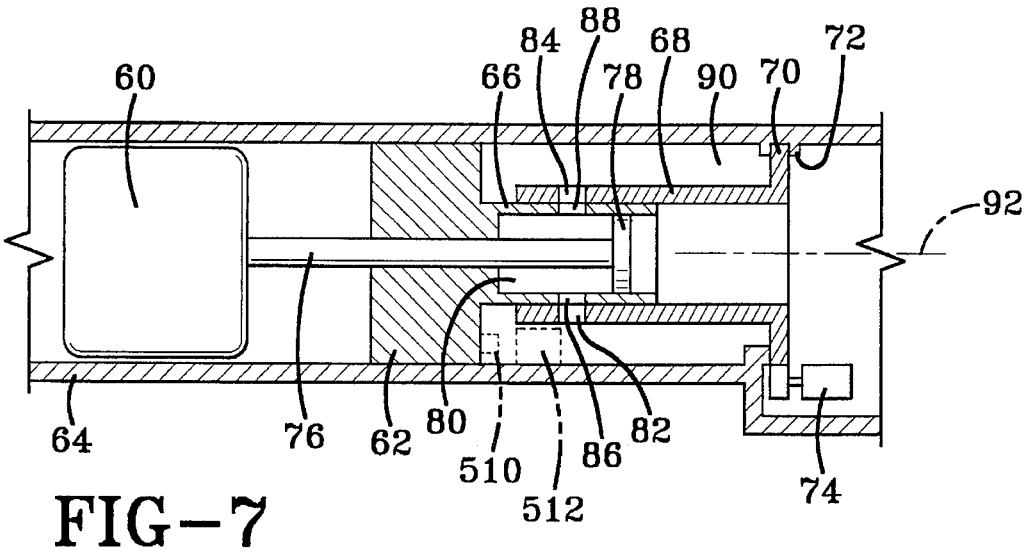
FIG-7
FIG-8
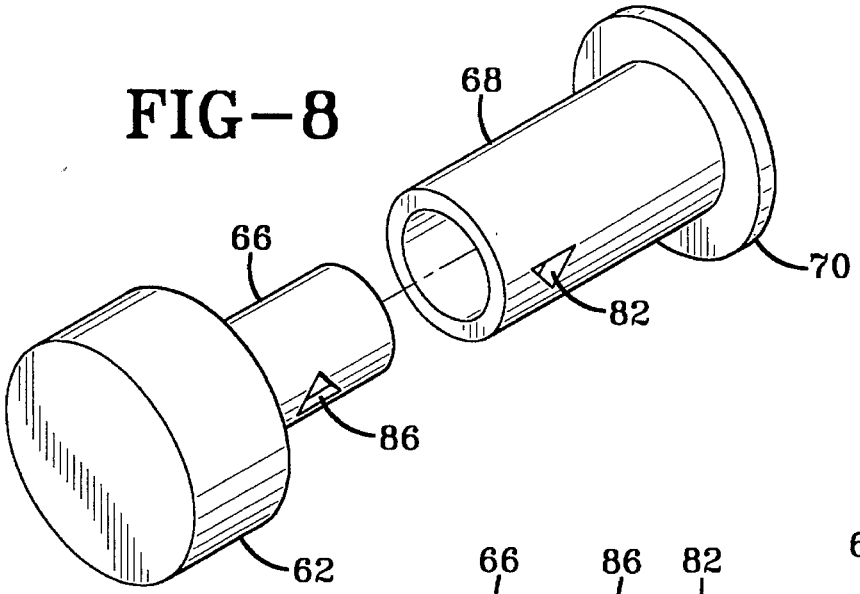
FIG-9
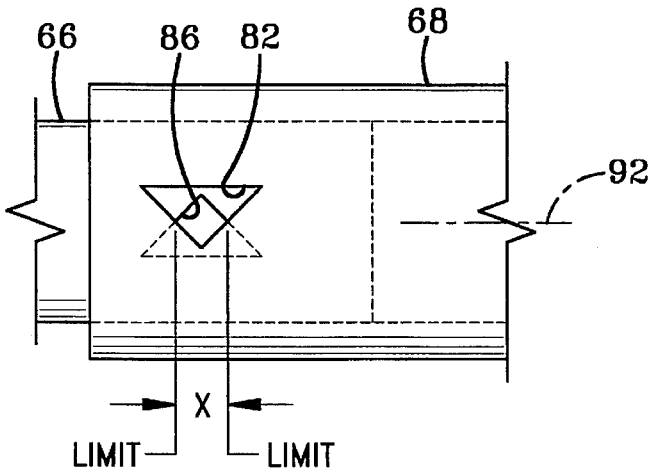

FIG-17
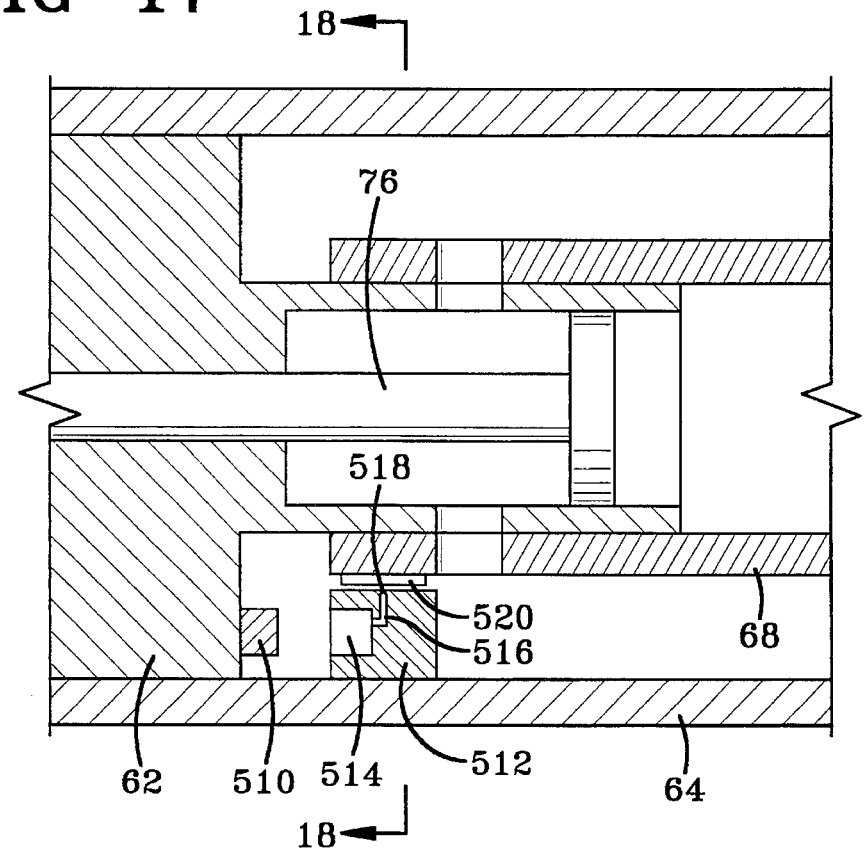
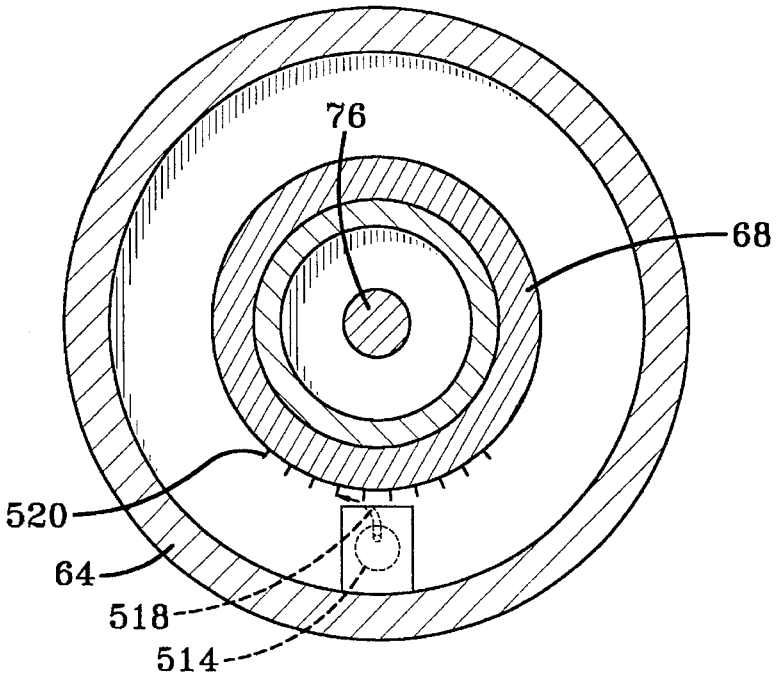
FIG-18

FREE PISTON STIRLING MACHINE HAVING A CONTROLLABLY SWITCHABLE WORK TRANSMITTING LINKAGE BETWEEN DISPLACER AND PISTON

This application is a continuation-in-part of my application Ser. No. 07/932,686, filed Aug. 20, 1992, and now U.S. Pat. No. 5,385,021.

TECHNICAL FIELD

This invention relates to the field of free piston Stirling engines and coolers, broadly termed Stirling cycle thermomechanical transducers or more simply Stirling machines. The invention is more specifically directed to power control and stroke limiting for Stirling cycle thermomechanical transducers.

BACKGROUND ART

Free piston Stirling engines usually drive a mechanical load such as a pump or an electrical alternator. Free piston Stirling coolers are usually driven by an electric or other motor to pump heat from one place to another, for example from the inside to the outside of a freezer cabinet. Due to fluctuations in load power demands for engines and heat transfer demands for coolers, the Stirling machine must have a power control to match the engine's output or the cooler's thermal transport rate to the needs of the system with which the machine is cooperating. For example, a free piston Stirling engine driving a load, such as an electrical alternator, with a varying power demand must increase or decrease engine power output accordingly.

The reason is that, if the load on an engine decreases or cooler thermal transport demand decreases, the amplitude of oscillation of the displacer and piston may increase beyond desirable limits, causing collision of internal engine parts and possible damage. Such overstroke occurs because the energy input to the Stirling machine equals the sum of the energy output and the energy losses. When a load demand decreases, the excess input energy is no longer coupled to that load so it tends to drive the displacer to a higher amplitude. The higher amplitude may be beyond a maximum design amplitude which can result in a runaway condition resulting in a damaging collision. Therefore, it is desirable to limit the amplitude of oscillation of the displacer and piston in the event of a substantial decrease in load demand.

There is, therefore, a need for a means for controlling the amplitude of oscillation of free piston Stirling machines and thereby control the power output of a free piston Stirling engine and the thermal transport rate of a free piston Stirling cooler.

BRIEF DISCLOSURE OF INVENTION

This invention is an improvement in a Stirling cycle thermomechanical transducer of the type having a power piston and a displacer which reciprocate freely within a housing. The improvement comprises coupling work at a higher rate (i.e. more power) from the displacer to the power piston when the piston displacement exceeds a selected displacement limit (the limit being along the piston's path of reciprocation and spaced from the piston's central position on that path) and coupling work at a lower rate (i.e. less power, preferably zero) from the displacer to the power piston when the piston displacement is less than that selected limit. To accomplish this, a variable work transmitting linkage, such as a spring or a damper, is mechanically coupled between the displacer and the power piston and a switch is connected to the work transmitting linkage for varying the quantity of power transmitted from the displacer through the linkage to the piston. The switch varies the spring constant of a spring, or the damping constant of a damper, during each cycle of reciprocation of the displacer and piston while the piston displacement exceeds the selected limit. The spring constant or damping constant is less, and may be zero, during the interval of piston translation while the displacement of the piston is less than the selected displacement limit. The displacement limit is spaced from the central position of the piston's path of reciprocation. During any portion of a cycle while the piston's displacement exceeds the selected limit, the spring constant or damping constant is greater, consequently coupling work at a greater rate from the displacer to the piston. If the piston's amplitude does not exceed the limit during the cycle, then the power transmitted from the displacer to the piston remains at the reduced or lesser value which preferably is essentially zero.

Changing the spring constant or damping constant changes the ratio of piston amplitude to displacer amplitude and also changes the relative phase of their displacement. This allows direct control of engine power or thermal transport by controllably varying the position of the limit.

The spring or damper work transmitting linkage couples power from the displacer to the piston. As it is made stiffer, that is a higher spring constant or damping constant K, the proportion of displacer power which is coupled from the displacer to the piston is increased. As a result, the increased stiffness leaves less power to displace the displacer, thereby retarding any increase in its amplitude (i.e. its maximum displacement) and therefore in turn reducing power to the piston because the displacer then moves a smaller fraction of the working gas between the hot and cold spaces than it would if no power were coupled to the piston. At the same time, the linkage also reduces the displacer phase lead ahead of the piston, and this also reduces cycle power.

Power output control, thermal transport control and stroke limiting are accomplished by varying the position of the displacement limit at which the work transmitting linkage is made stiffer to increase its power transmission. For such control, the position of the limit is varied as an increasing function of load demand, either manually or automatically by a control system.

BRIEF DESCRIPTION OF DRAWINGS

FIG. 4 is a graph illustrating the variations in the spring constant or damping constant as a function of position displacement in an embodiment of the invention.

FIG. 5 is a graph illustrating the variation in the duty cycle of the higher power transfer from displacer to piston as a function of piston amplitude.

FIG. 6 is a graph illustrating the operation of an embodiment of the invention.

FIG. 7 is a diagram illustrating the preferred embodiment of the invention.

FIG. 8 is a view in perspective of the piston and rotating sleeve components of the embodiment illustrated in FIG. 7.

FIG. 9 is a detailed view of the cooperating ports illustrated in FIG. 8.

FIG. 17 is a view in axial section of a portion of the embodiment of FIG. 7 showing an added fail-safe enhancement.

FIG. 18 is a view in section taken along the line 18—18 of FIG. 17.

Figure 1:
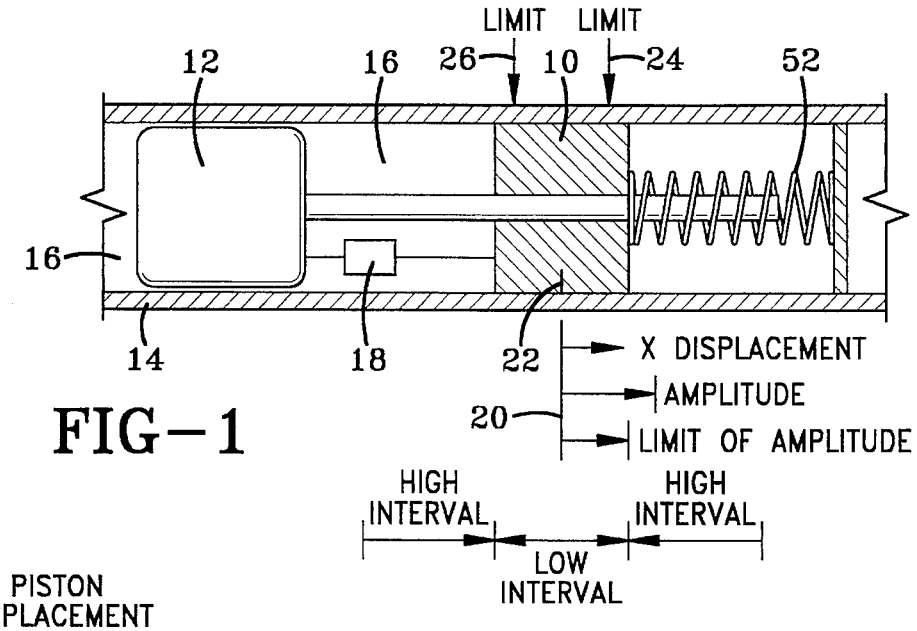
FIG. 1 is a diagrammatic illustration of the relevant component parts of a free piston Stirling transducer illustrating the concept of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates, in a diagrammatic manner, the component parts of a free piston Stirling engine or cooler which are relevant to the present invention. Some dimensions are somewhat exaggerated in order to illustrate the concepts of the invention. Furthermore, the entire engine is not illustrated because the prior art illustrates so many different kinds of free piston Stirling engines to which the present improvement is applicable. Therefore, the discussion is limited to those relevant component parts.

In a free piston Stirling machine, a piston 10, having a substantial mass, and a displacer 12, usually of relatively small mass, reciprocate within a cylinder 14. The piston is sprung to the cylinder so that it is resonant at a selected frequency such as 60 Hz. A Stirling machine is sometimes referred to as a thermal oscillator because the piston and displacer reciprocate in a periodic, resonant manner, accompanied by the transfer of thermal energy from the cylinder and cylinder head walls at one end of the displacer to the cylinder walls at the other end of the displacer, all in a manner which is well known to those skilled in the art. The displacer functions to displace working gas in the cylinder 14 from one end to the other end of the displacer as the displacer reciprocates back and forth within the cylinder 14. The amplitude of displacer reciprocation is proportional to the volume of gas displaced during each cycle. As a result, in a free piston Stirling engine the displacement of more gas causes more substantial variations in the pressure of the working gas in the work space 16, and results in a greater amplitude of reciprocation of the piston 10. Similarly, in a free piston Stirling cooler, a greater amplitude of oscillation by the displacer causes the displacement of a greater quantity of working gas and consequently the pumping of more heat from one end to the opposite end of the displacer 12. As is well known in the prior art, power is coupled to the displacer 12 to drive it in its reciprocating motion by the variations of working gas pressure.

The purpose of the present invention is to control or limit the amount of net power delivered to the displacer during each cycle and thereby control or limit its amplitude and phase with respect to the piston. The net power delivered to the displacer is controlled in the present invention by mechanically coupling the displacer to the power piston by a power transmitting linkage which can be switched or varied during each cycle. This power transmitting linkage can couple to the piston some of the power delivered to the displacer by the working gas. By coupling away from the displacer to the piston some of the power delivered to the displacer by the working gas, the net power delivered to the displacer is reduced and therefore the increase in the amplitude of the oscillation of the displacer is reduced. The reduction in net power delivered to the displacer and the consequent reduction in the increase of its amplitude of reciprocation results in less heat energy being pumped by the working gas and less amplitude of reciprocation of the piston 10.

The power transmitting linkage 18, which is mechanically connected between the displacer 12 and the piston 10, may be a spring or a damper and in practical embodiments of the invention has both some spring effect and some damper effect. The application of a force to a spring causes the spring components to move with respect to each other and results in the storage of energy within the spring and the application of an equal and opposite force at the opposite end of the spring The application of force to a damper also causes motion of the component parts of the damper and during such motion causes the application of an equal and opposite force at the opposite end of the damper, and the dissipation of energy in the damper. Consequently, each device can be used as a work transmitting linkage to apply a force from one body to another and therefore to deliver power from one body to another. As will be seen, the power transmitting linkage need not be physically located in the space between the displacer and piston, but must only be linked between them.

Typical springs are gas springs, which utilize the resilient compression and expansion characteristics of a gas to attain the spring characteristic, and electromagnetic springs which utilize the attraction or repelling forces of the two interacting magnetic fields of two magnets as a spring. Dampers include such devices as dash pots and braking mechanisms. Inevitably, neither a spring nor a damper is perfect so that every spring has some damping effect associated with it and every damper has some spring effect associated with it. For example, the friction and dynamic flow losses from leakage flow of a gas spring and the resistive heat losses in a magnetic spring are damping effects, while the compressibility of the fluid of a gas spring, the reactance of the elements of a magnetic spring, and the resilience of components in a brake mechanism provide some minor spring effect for dampers. Consequently, a device is termed a spring if its predominant effect is that of a spring, and is termed a damper if its predominant effect is that of a damper.

In the present invention the use of springs is preferred because they achieve a greater thermodynamic efficiency because springs store and release energy, while dampers simply dissipate energy. Damping is, therefore, an irreversible process, while springs only transfer or store the energy.

Nonetheless, the desired power control of the present invention can be achieved by any combination of spring and/or damping effect.

The power transmitting linkage 18 is referred to as mechanically connected between the displacer and piston. "Mechanically" means connected by some apparatus or structure, something more than just the working gas linking the displacer and piston in the conventional manner. It includes magnetic springs, gas springs, and other types of spring and damper structures.

The effectiveness of a spring or damper is conventionally described in terms of a proportionality constant. The proportionality constant for a spring is the spring constant $K_s$ which is the ratio of the force applied to the spring to the displacement of the spring. The proportionality constant for a damper is the damping constant $K_d$ and is defined as the ratio of the force applied to the damper to the velocity of its motion. Springs and dampers can have a proportionality constant varying upwardly from zero. The higher the proportionality constant, the stiffer or more rigid is the device, and consequently greater the amount of power which may be transmitted through it from the displacer to the piston.

In the present invention the power coupling linkage, the spring or damper, may be switched between a lower value of K to couple less power from the displacer to the piston to a higher value of K in order to couple more power from the displacer to the piston.

The term "displacement" of the piston refers to the instantaneous distance of piston travel from its central average position. The term "amplitude" refers to its maximum displacement during a cycle and corresponds to the length of the rotating phasor as is well known to those skilled in the art. The term "work" defines an amount of energy and the rate of work is power. In describing the invention, reference is made to more or less power or rate of work. These terms are used to designate the relative power under one condition as related to the power under another condition. "More" or "less" simply mean more or less than some unimportant interposed value.

Referring to FIG. 1, the central position of the piston's reciprocation path is aligned along the line 20. For reference, an index mark 22 is drawn on the piston 10. In preferred embodiments of the invention, the power coupling linkage couples no power from the displacer to the piston while the piston displacement is less than the selected limits 24 and 26 from the spaced central position 20. This may occur, for example, with low amplitude reciprocation, such as illustrated in graph 28 in FIG. 2 in which piston reciprocation never reaches the limits 24 and 26. However, if the amplitude of the reciprocating oscillations of the piston 10 exceeds the position of the limits 24 and 26, the power transmitting linkage 18 is switched from a low power transmitting state, that is low K, to a high power transmitting state, that is high K, while the piston 10 exceeds the limit positions 24 and 26. This is illustrated, for example, in graph 32 of FIG. 2, which illustrates that the power transmitting linkage 18 is at a high power transmitting state during intervals 34, 36, 38, and 40 of each cycle.

Figure 2:
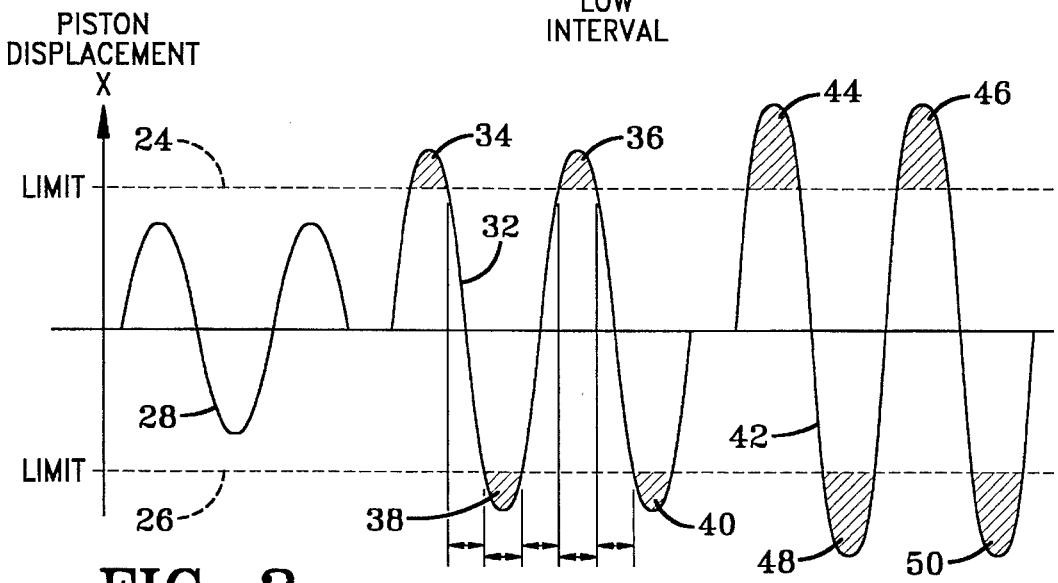
FIG. 2 is a graphical diagram illustrating the motion of the piston and the operation of the invention of FIG. 1.

In the event that the amplitude of oscillation of the piston 10 is even more excessive, as illustrated at graph 42 of FIG. 2, the intervals of each cycle during which the power transmitting linkage is switched to its high power transmitting state are even greater. Thus, for the amplitude illustrated in graph 42, the piston and displacer spend more time at a higher power coupling state and therefore even more power is coupled from the displacer to the piston than for the amplitude of graph 32.

FIG. 4 illustrates the change in the proportionality constant of the spring or damper as a function of piston displacement. For displacements on either side of the center 20, but less than the limits 24 and 26, the preferred embodiment exhibits a proportionality constant of essentially zero so that no power is transmitted from the displacer to the piston. However in the preferred embodiment the proportionality constant is switched to a finite value as the piston passes the limits. By way of example, the limits may be positioned 11 millimeters from the center, while the piston may typically reciprocate with an amplitude of 14 millimeters. For a spring-type power transmitting linkage, the spring constant in the high spring constant state is typically ¼ to ⅓ of the spring constant of the spring 52 which is used to resonate the piston 10. For example, a spring of 143 newtons per millimeter may be used to resonate a 1 kilogram piston at 60 Hz. With such a piston, the spring constant of the power transmitting linkage embodying the present invention would be approximately 30 newtons per millimeter when switched to its high power transmitting state.

The self-limiting stability of a free piston machine utilizing the power transmitting linkage of the present invention is simply explained in connection with FIG. 5 in terms of the duty cycle of the high state of the linkage. For amplitudes of piston oscillation less than the selected limit, there is relatively little or no power coupled from the displacer to the piston. However, whenever the piston displacement exceeds the limit, the power transmitting linkage is switched to its high power transmitting state and couples power from the displacer to the piston to reduce the net power acting upon the displacer to less than it would be if no power were coupled from the displacer to the piston. As piston amplitude increases, the duty cycle during which the power transmitting linkage is in its high power transmitting state is increased proportionally. Consequently, as piston amplitude increases, an increasing proportion of power is coupled from the displacer to the piston, consequently resulting in self-limiting operation.

The self-limiting operation is further illustrated in FIG. 6. FIG. 6 illustrates a power versus amplitude curve which is common for the free piston Stirling engine. As piston amplitude increases, the power output of the machine increases until piston amplitude reaches limit $X_1$. As the piston amplitude increases above $X_1$, an increasingly greater proportion of power is coupled from the displacer to the piston, thus reducing the increase in amplitude of the displacer and consequently reducing machine power until an equilibrium is reached at the intersection of the curve with the load line 54.

FIGS. 7–11 illustrate the preferred embodiment of the invention. Referring to FIG. 7, a displacer 60 and piston 62 reciprocate within a cylinder 64. The piston 62 is provided with a cylindrical skirt 66 forming the central slide member of a spool valve. The inner cylindrical surface of an outer cylindrical sleeve member 68 sealingly and slidingly engages the outer surface of the central slide member 66. Additionally, the outer sleeve member 68 has an annular flange 70 which is pivotally secured in a bearing such as an annular groove 72 surrounding the interior of the cylinder 64. The outer sleeve member 68 is driven in rotary motion by a drive motor or rotary solenoid 74. A connecting rod 76 extends from the end of the displacer 60 in sealing and slidable engagement through the piston 62 and has a gas spring piston 78 formed at its opposite end. The piston 78 sealingly slides within a cylindrical chamber 80 which together form a gas spring. This gas spring forms a power transmitting linkage which mechanically couples the displacer 60 to the piston 62. Ports 82 and 84 through the outer sleeve member 68 and cooperating ports 86 and 88 in the central slide member formed by the skirt 66 of the piston 62, open the spool valve when they come into registration.

If the piston 62 reciprocates at an amplitude of less than the effective axial dimension of the ports 82–88, the ports will at all times during each cycle remain open and consequently will vent the chamber 80 to the backspace 90 of the Stirling machine. So long as the ports 82–88 are in at least partial registration, the chamber 80 cannot operate to provide a spring effect and therefore operates as a spring with a spring constant of zero. However, whenever piston displacement is greater than the effective axial dimension of the ports, such that the ports 82–88 are no longer in communication, the chamber 80 becomes sealed and begins to act as a spring when the ports are out of registration. Consequently, for displacements of the piston from its center beyond the effective axial length of the ports 82–88, the gas spring which utilizes the chamber 80 switches from a spring constant of zero to a finite spring constant which then allows the gas spring to couple power from the displacer to the piston in the manner described above. In this embodiment, it is the spool valve formed by the central slide member 66 and the outer sleeve member 68, and their respective ports 82–88, which forms the switch, switching the work transmitting linkage from a zero power transmission state to a finite and substantial power transmitting state while the piston displacement exceeds the limit of the effective axial length of the ports 82–88.

FIG. 8 illustrates an exploded or separated view of the piston 62 and outer sleeve 68, which are illustrated in FIG. 7. The ports (82 and 86 being visible) have triangular configurations with a base of each port being aligned parallel to the axis 92 of the Stirling machine. The apexes which are on the opposite side of these bases point in circumferentially opposite directions. As a result these triangular ports may come into registration in the manner illustrated in FIG. 9. The inner port 86 reciprocates parallel to the axis 92 and from FIG. 9 it is apparent that the distance between the limits of reciprocation at which the ports no longer register is the distance X illustrated in FIG. 9.

Figure 10:
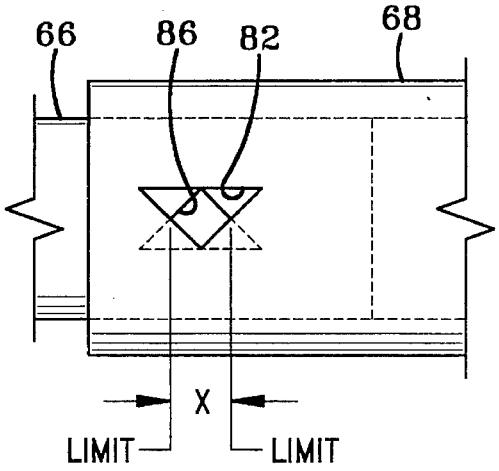
FIGS. 10 and 11 are diagrams of the structures illustrated in FIG. 9 in different cooperating positions of adjustment.
Figure 11:
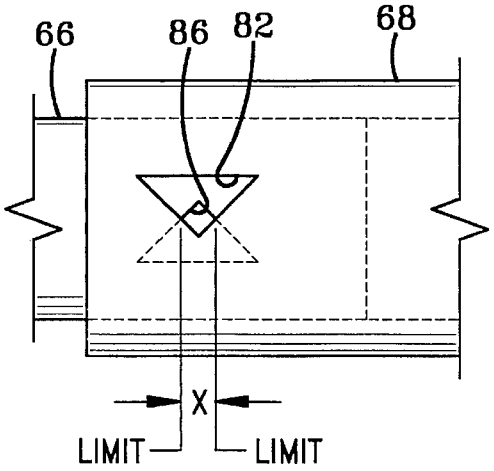

This triangular configuration permits rotation of the outer sleeve 68 by means of the motor or rotary solenoid 74 to cause circumferential movement of the inner port 86, with respect to the outer port 82. Therefore, as illustrated in FIGS. 10 and 11, this rotation in one direction, as illustrated in FIG. 10, increases the distance X between the limits shown in FIG. 10, and rotation in the opposite direction decreases the distance between the limits as shown in FIG. 11.

Consequently, the embodiment of FIG. 7 not only couples the displacer to the piston by a power transmitting linkage in the form of a gas spring, but also permits the adjustable variation of the positions of the displacement limits at which the power transmitting state of the linkage is switched from one state to the other, i.e. from a high power coupling state to a low, essentially zero, power coupling state. The control current of the rotary solenoid or motor 74 thus varies the angular position of the rotatable, outer sleeve member 68 of the spool valve, so as to vary the position of the limits at which there is a cut off of the outlet of gas from the chamber 80 of the gas spring connected between the displacer and the piston.

This gas spring, or any other power transmitting linkage, connected between the displacer and piston may be referred to as a relative power transmitting linkage or relative gas spring because it responds to the relative motion between the piston and displacer. When the spool valve cuts off the outlet ports 82–88, the gas spring becomes operative, otherwise it is inoperative.

The outer sleeve member 68 is pivotally biased on the ground or cylinder of the engine so it can be rotated against the bias force by variations in the current of the motor or rotary solenoid 74. The piston 62 does not rotate so that as the piston moves in and out, its skirt 66 encounters the port in the outer sleeve member 68, so as to cut off the gas spring ports 82–88 and activate the stiff, relative gas spring. This feature limits the piston amplitude automatically to some maximum value. The variable rotational position of the spool valve is a further element of control which may be activated externally by, for example, a control signal which senses alternator voltage and permits adjustment of the engine stroke to keep it constant in the event of a change in alternator voltage by rotating the outer sleeve member of the spool valve with an electromagnet. In particular, the alternator voltage is sensed and the spacing between the limits is controllably varied as the decreasing function of the voltage of the alternator which may be done by means of a conventional feedback control system to provide voltage regulation. In such a system, any increase in voltage which is detected is compensated for by a resulting narrowing of the limits which in turn reduces piston amplitude and therefore reduces output voltage in accordance with well known principles of negative feedback control and alternator operation.

Therefore it can be seen that two quite independent things are accomplished with this embodiment of the invention. First, the sleeve, port shape and way of interaction with the moving piston makes the relative gas spring inoperative as long as the piston motion does not exceed the selected amount in either direction, as determined by the size and shape of the cooperating ports in the piston and the outer control sleeve member 68. However, when the piston displacement exceeds this predetermined displacement limit, the displacer motion is progressively attenuated by the relative spring and the engine power begins to be reduced so that above the selected piston displacement limit, no power at all is delivered by the engine cycle to the piston and runaway is prevented, even if there is no load on the piston. Thus, the engine is unconditionally stable under any load or absence of load. This is a highly desirable feature previously unavailable to free piston engines without complex, external controls. This first type of action does not require rotation of the outer control sleeve, but is a built-in feature which is automatically in effect.

The second thing which is accomplished by this embodiment is that rotation of the outer control sleeve member changes the position of the selected limits and thus changes the piston amplitude at which the ports cut off flow through the ports into and out of the relative gas spring and allow the spring to become effective. This rotation gives the capability to control engine power stroke or voltage or to shut down the engine.

The shape of the two interacting ports is designed so that there is a sudden cutoff of the gas flow through the ports if the piston displacement exceeds the selected limit in either direction. Thus, the relative gas spring is active in proportion to the distance by which the piston amplitude exceeds the selected limit. The piston power is attenuated in proportion to the fraction of the cycle in which the spring is active, and its stiffness, resulting in a rapid drop in piston power beyond the selected limit. At a sufficient amplitude beyond the selected limit, which depends on the design stiffness of the relative spring, the piston power becomes zero and an entirely unloaded engine will operate at that amplitude. As load on the piston is increased above zero, as for example with an increasing current through an alternator connected to a Stirling engine, the piston amplitude will decrease, the relative action of the spring will decrease (the duty cycle of the spring will decrease), and the piston power will rise to the point that it matches the imposed load. At this point the engine operation is stable and no further change in piston amplitude will take place until the alternator or other load changes. That does not require a sleeve rotation, but is determined by the geometry and design of the springs and ports.

Rotation of the sleeve will change the selected limit positions at which the relative spring comes into action, thus changing the power of the engine and from that changing its amplitude. If, for example, the engine is operating into an electric load at a voltage higher than a desired voltage, then a rotation of the sleeve so as to reduce the distance between the limits can be effected to reduce piston amplitude and voltage to the desired value. However, at any rotational position of the sleeve and given any distance between the limits, the absolute stability still occurs. Rotation changes only the spacing between the limits and not the progressive effect of the relative spring on power as amplitude increases. Similarly, rotation of the sleeve can be made to change the engine power from zero to a maximum safe value regardless of the load imposed, as long as the load is not beyond the engine power capability. Typically, a Stirling engine operating range is between the zero power amplitude illustrated at Y in FIG. 6, and the maximum power amplitude illustrated at Z. The rotational position of the outer sleeve member 68, when rotated to reduce the distance between the selected limits, simply moves operation along a new Y'-Z' curve. Thus, as the distance between the limits is reduced by rotation of the sleeve, the operable, downward drooping portion of the curve in FIG. 6 is shifted to the left and can be shifted in that manner to any point inwardly of the limits with maximum spacing.

The motor or rotary solenoid 74 is one of many well known means for rotatably driving the outer sleeve 68 to adjust the angular position of its ports. One such well known means is an electromagnet which operates on an iron core attached to the sleeve in such a manner as to allow rotation of the sleeve when the electromagnet is energized by some external control signal, which may, for example, be generated by the alternator voltage exceeding a desired upper limit. Another useful means for causing the sleeve to rotate is a pressure activated piston which can, for example, be driven by a one-way valve fed from the working space so if the working space maximum cycle pressure exceeds a set value, the working pressure on the piston will rotate the power control sleeve 68 to reduce piston amplitude and therefore cycle pressure. When the maximum pressure is reduced below the set maximum, then normal leakage of the valve and piston allows a spring loaded sleeve to return to its normal rotational position. This pressure activated rotation can be in combination with or instead of other means of controlling rotational position of the sleeve.

It will, of course, be apparent to those skilled in the art that there are many, many other drive means, electrical, mechanical, pneumatic, hydraulic, and others, which can be used to effect rotation of the sleeve with or without external control signals and hence control the power and stroke of the machine.

Figure 12:
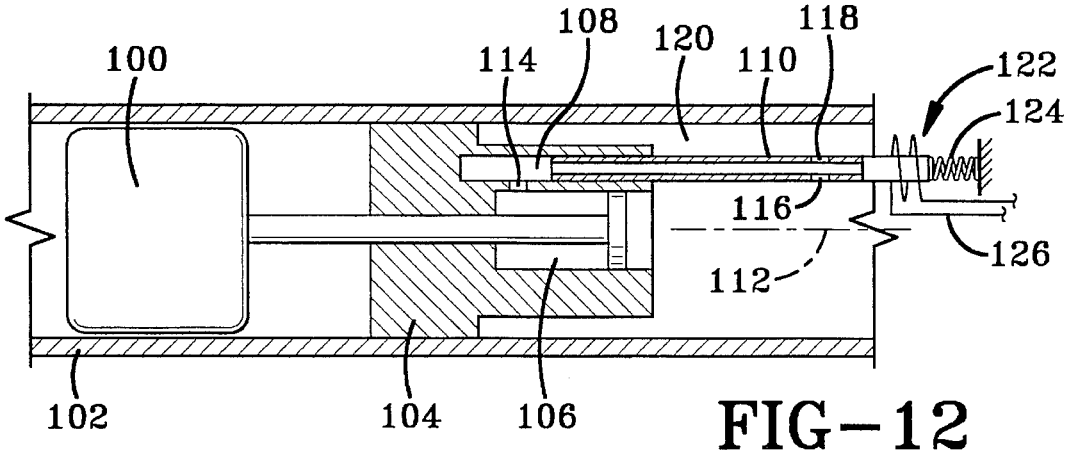
FIG. 12 is a diagram illustrating an alternative embodiment of the invention.

FIG. 12 illustrates an alternative embodiment of the invention. It shows a displacer 100 reciprocating in a cylinder 102, along with a power piston 104. The embodiment of FIG. 12 has a gas spring with a chamber 106 which is like the gas spring illustrated in FIG. 7. However, instead of a surrounding rotatable sleeve, the piston 104 is provided with a radially offset bore 108 which sealingly slides with respect to a contained tube 110 parallel to the central axis 112. The chamber 106 of the gas spring connecting the piston 104 to the displacer 100 is provided with a port 114 to allow communication from the chamber 106 through the port 114 and through the tube 110 and out radial ports 116 and 118 opening into the backspace 120.

As the piston 104 reciprocates, a sufficient displacement to the right in FIG. 12 will cause the port 114 to be covered and blocked by the outer wall of the tube 110. When the port 114 is blocked, the chamber 106 is sealed and the corresponding gas spring becomes effective, and therefore switched to its high power transmitting state. In this embodiment, the power transmitting linkage is effective at only one end of the excursion and thus only once during a cycle, rather than at both ends and twice during a cycle, as with the embodiment of FIG. 7.

The tube 110 may be adjusted in the axial direction by means of a solenoid 122. The solenoid 122 is spring biased in one direction by a spring 124 and is moved against the spring in the opposite direction in proportion to the current through a coil 126, forming part of the conventional solenoid. The coil 126 is connected to a control voltage which is proportional to the voltage across the alternator so that it will move the tube to the right in FIG. 12 and thus enlarge the selected displacement limit as alternator voltage decreases and reduce the displacement limit by moving the tube 118 to the left in FIG. 12 in response to an increase of alternator voltage above a desired amount.

Therefore, it has been found that the spring or other power transmitting linkage must only be active in a fraction of the cycle for adequate power and stroke control, and that it may be active at one or both ends of the reciprocation path of the piston.

Figure 14:
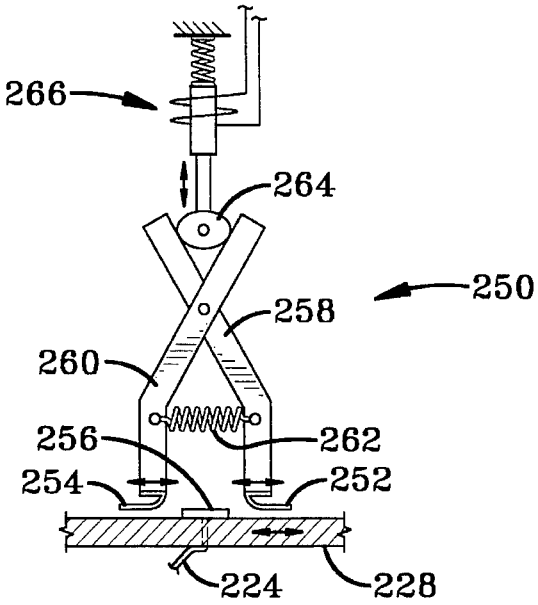
FIG. 14 is a detailed view of a limit adjusting mechanism used in the embodiment of FIG. 13.
Figure 13:
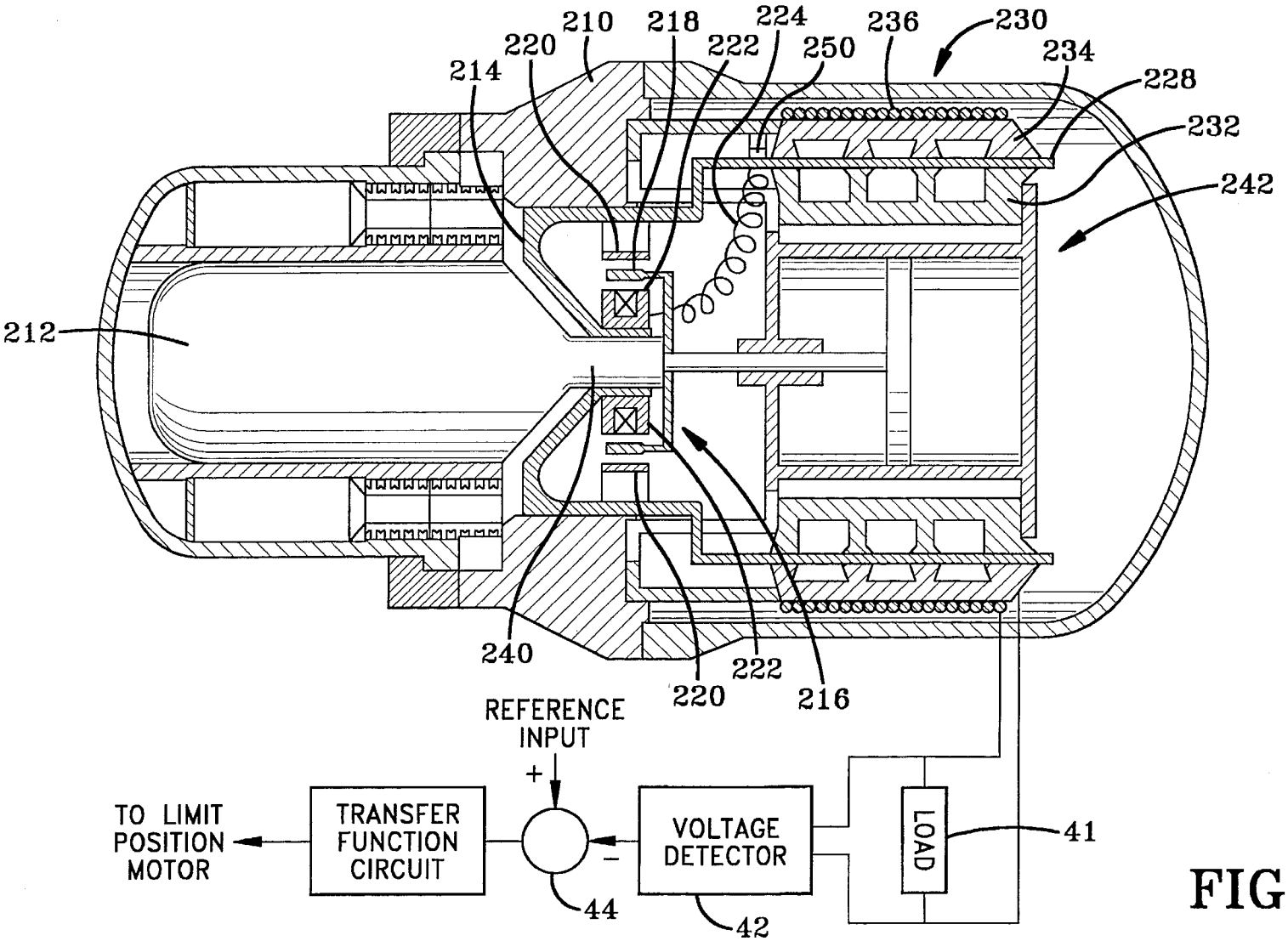
FIG. 13 is a view in axial section of another alternative embodiment of the invention.

FIGS. 13 and 14 illustrate yet another embodiment of the present invention. FIG. 13 shows a free piston Stirling engine 210 having a displacer 212, a piston 214 and an electromagnetically actuated spring 216 mechanically connected between them. This embodiment of an electromagnetic spring is the equivalent of a conventional linear motor between the displacer 212 and the piston 214, in which the moving magnet 218 is attached to the displacer 212, and the flux path 220 and armature winding 222 are attached to the piston 214. Such a linear motor can be made to have a very low power factor by making the armature inductance large, so that when the armature current is flowing, the alternator has a very low power factor, and the force on the magnet lags the armature voltage a large fraction of 90 degrees. Therefore, the forces are nearly in the same phase relation as those of a relative mechanical spring ie, almost in proportion to the relative displacement between displacer and piston. This relative spring can be varied in stiffness by controllably varying the armature current, with the higher current causing a higher spring constant. Therefore the armature current may be switched on and off or just varied in magnitude to switch the electromagnetic spring when the piston displacement is more than or less than the selected limit.

This switching may be accomplished, for example, by a slide switch mechanism 250, illustrated in more detail in FIG. 14. The slide switch mechanism has movable, electrical contacts 252 and 254 both of which are connected to a source of electrical power for powering the armature of the electromagnetic spring. A contact 256 is mounted on the alternator magnet mounting skirt 228 and connected to the armature winding 222. When the piston displacement is sufficient to bring the contact 256 into physical contact with electrical contact 252 or 254, then a circuit is formed to apply power to the armature winding 222 and actuate the electromagnetic spring so that the spring is actuated when piston displacement exceeds the selected limits determined by the position of the contacts 252 and 254.

The contacts 252 and 254 are mounted to pivotable arms 258 and 260 and biased towards each other with a spring 262. A cam 264 is driven in adjustable, vertical reciprocation by a solenoid 266. Therefore, any spacing between the contacts 252 and 254 is proportional to the voltage applied to the solenoid 266, and that voltage can be used to control the spacing of the limits.

In the embodiment of FIG. 13 the piston 214 drives the permanent magnets 228 of an electrical power generating linear alternator 230. The permanent magnets 228 reciprocate space between pole pieces 232 and 234 upon which an armature 236 is wound. This alternator 230 in the illustrated embodiment forms no part of the invention. FIG. 13 also illustrates a displacer connecting rod 240 connecting the displacer to a gas spring fixedly mounted in the housing of the engine 210, interiorly of the alternator 230 for conventional purposes.

The current for actuating the electromagnetic spring 216 is fed from a wire 224 attached to the casing of the machine and supported by a flexing member to the electromagnet. The stiffness of such an electromagnetic spring is proportional to the current through its coil, as is well known. Thus, the stiffness of the spring can be controlled not only by turning the armature current on and off by means of the switch controls of FIG. 14, but also by varying the magnitude of the current. When, for example, when coil current is increased, the spring constant K, is increased. Therefore a greater proportion of energy is coupled from the displacer 212 to the piston 214. As more energy is coupled from the displacer 212 to the piston 214, less energy is available to drive the displacer 212. Therefore, the increase in the amplitude of the displacer 212 is retarded.

FIG. 13 also diagrammatically illustrates a simple control system as an example of the kind of feedback control system which might be utilized with the present invention. The output of the alternator 230 is applied in the conventional manner to a load 241. A voltage detector 242 detects the alternator output voltage and its output signal is applied along with a reference input signal to a summing junction 244. Consequently, the output of the summing junction 244 represents the error or difference between the desired output voltage and the reference input. The error signal from the summing junction 44 is applied through a high gain transfer function circuit to the solenoid 266 to switch its spring constant and maintain a nearly constant output voltage. In this way the spacing of the limits is varied as a decreasing function of the alternator voltage to maintain a nearly constant voltage.

Once the principles of the present invention are understood for switching the spring constant in order to control power or thermal transport and to limit piston and displacer amplitude, many different types of systems for switching the spring constant will be apparent to those skilled in the art or will become apparent in the future. For example, the springs may be gas or magnetic or combinations, including combinations of mechanical and electromagnetic springs. The spring constant of gas springs may be varied by variations in the pressure of the gas spring. A variety of mechanical structures may also be created for varying the volume of the gas spring and for varying the pressure of the gas spring by pumping gas into and out of the gas spring chamber.

Switching of spring constants and damper constants is not limited to step function switching, but can also be continuous smooth switching over a range which is a function of piston displacement.

Furthermore, in addition to having only one or two limits, there may be multiple limits on either side of the center position of the piston. The switching for the embodiment of FIG. 13 can be accomplished by an electrical switch, such as that illustrated in FIG. 14, but having multiple contacts. For example, an additional pair of contacts, like those of 252 and 254 in FIG. 14, may be positioned outwardly or inwardly of the contacts 252 and 254 and connected to a source of power delivering a different current to the electromagnetic spring, and thus initiating a different spring constant as a result of a different displacement of the piston to the additional limits. Similarly, a more complicated spool valve having multiple passageways, and modelled after the many existing prior art spool valves, can provide communication to multiple springs or additional chambers, each providing a different spring constant Further, a great variety of means for detecting power or stroke will also be apparent to those skilled in the art, along with a substantial variety of control systems for utilizing a detected power or stroke signal to generate a control signal for varying the spring constant. However, since this invention is principally the discovery that a spring or damper between the displacer and piston of a free piston Stirling engine or cooler may be controllably switched to different values of proportionality constant K within cycles of operation in order to control the rate at which work is done by the free piston Stirling machine and the invention is not a detector or control system technology, further of these examples are not provided.

These explicit examples should not be interpreted to reduce the generality of the basic invention, which is a spring or damper of any sort—electrical, mechanical pneumatic or other—which can be switched to change its K during repetitive cycles to control displacer amplitude and phase so as to control power output of the Stirling cycle.

Figure 15:
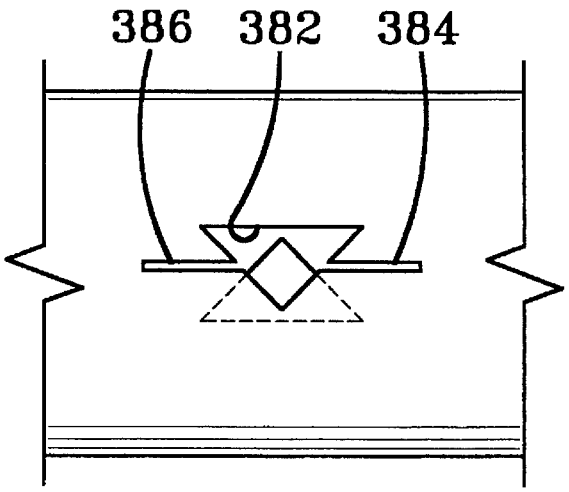
FIG. 15 is a drawing illustrating alternative ports similar to those illustrated in FIGS. 9–11, but for providing damping operation.

FIG. 15 illustrates an embodiment of the invention using a damper instead of a spring for coupling power through a power transmitting linkage from the displacer to the piston. This embodiment is like the embodiment illustrated in FIGS. 7–11, except that the shape of the port 82 has been changed to the shape of port 382 in FIG. 15. The port 382 has a pair of elongated slots 384 and 386 extending in the axial direction to provide additional opening. The axially extending slots 384 and 386 assure that some communication remains after the limits are reached. However, the size of the port is substantially diminished to the narrow region of the slot when the displacement of the piston exceeds the limit. As a consequence, the spring characteristic is substantially reduced and the energy dissipating characteristic is enlarged as a result of the dynamic flow losses from pumping the gas through the narrowed slots.

Figure 16:
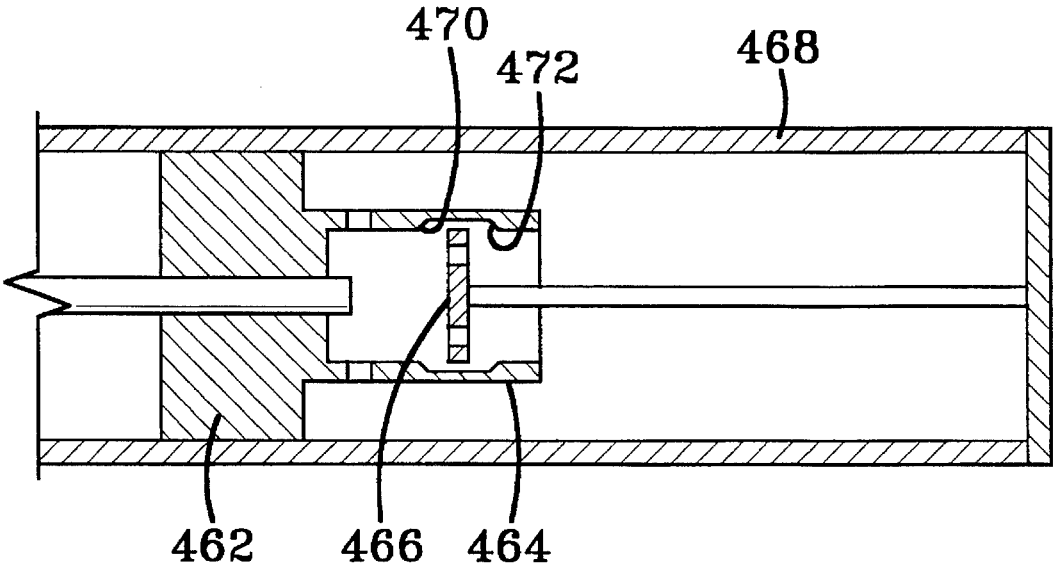
FIG. 16 is a view of component parts of a Stirling machine illustrating yet another alternative embodiment of the invention.

FIG. 16 illustrates yet another embodiment which is similar to the embodiment of FIG. 7 except that the piston 462 of FIG. 16 has a skirt 464 of high friction material which can engage a cooperating disk 466 attached to the housing 468. When the piston 462 reciprocates with relatively small displacement, the skirt 464 does not engage the disk 466. However, when the limits are reached and the annular shoulders 470 and 472 travel to the disk 466, the skirt 464 frictionally engages the disk 466. The frictional engagement dissipates energy and damps further excursions of the piston 462. This braking engagement of the disk 466 with the narrower diameter interior wall of the skirt 464 switches the damping structure from essentially no damping, when there is no contact, to substantial damping for piston excursions beyond the limit.

Figure 3:
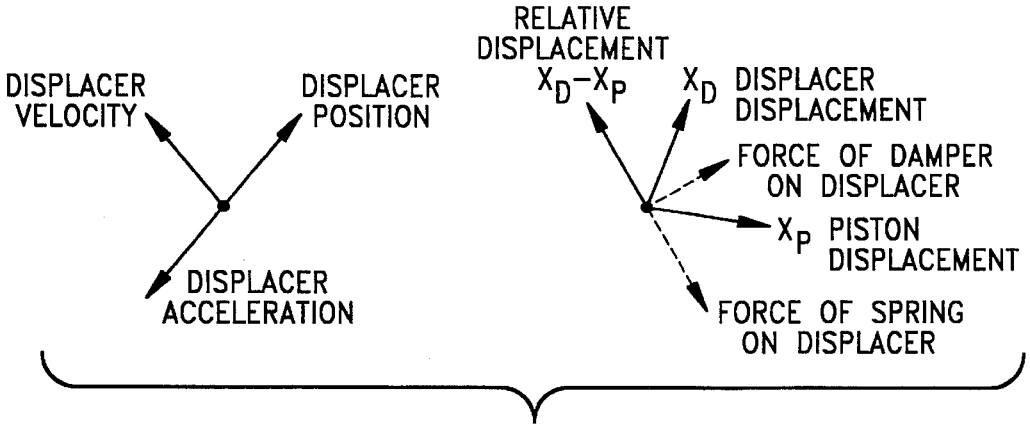
FIG. 3 is a pair of related phasor diagrams illustrating the motion of the displacer and piston and the forces of the displacer or damper of the present invention.

FIG. 3 is a typical displacer-piston phasor plot but showing the effect of the spring effect and damping effect of a practical relative spring having significant damping. The relative spring force is in such a direction, nearly colinear with displacer velocity, as to extract work from the displacer, thus reducing the displacer's amplitude. The relative damper force is in a direction nearly colinear with the position phasor so as to reduce the displacer spring stiffness, thus reducing its natural frequency and from that its phase lead over the piston. Thus, from this phasor diagram, it can be seen that both effects—displacer amplitude reduction from the relative spring and displacer phase lead reduction from relative damping, cause a power reduction of the cycle, which is the desired effect of the power transmitting linkage of the present invention.

The engine designer is thus released from the need to provide a perfect spring, because any damping included with a spring will also reduce engine power. In fact, a relative damper without spring effect will also permit power control, but with more energy loss and a greater reduction of thermal efficiency than that caused by a relative spring power control. In other respects, such as engine stability, the relative damper gives advantages similar to that of the relative spring. Thus, both springs and dampers, and combinations of them, provide the advantages of the present invention.

FIGS. 17 and 18 illustrate a fail-safe enhancement which may be added to embodiments of the invention, such as the embodiment of FIG. 7. The purpose of the fail-safe mechanism is to limit piston displacement, even in the event of the failure of the motivating power which varies the displacement limits under normal conditions. For example, in the event electrical power to the drive motor or rotary solenoid 74 fails, the fail-safe mechanism can still rotate the sleeve member 68. However, the principles of the fail-safe mechanism are applicable where the displacement limit is varied by the motion of any movable body.

The fail-safe mechanism comprises a fluid pump, such as the combination of a piston 510 and pump body 512 shown in phantom on FIG. 7. FIGS. 17 and 18 illustrate these mechanisms in more detail. The pump piston 510 is mounted to the Stirling piston 62 for sealing, slidable receipt in a pump cylinder 514 formed in the pump body 512. So long as the displacement of the Stirling piston 62 does not exceed a fail-safe displacement at which the piston 510 enters the cylinder 514, the fluid pump will be of no effect. However, when the piston displacement exceeds that fail-safe displacement, the piston 510 enters the cylinder 514 once during each cycle pumping working gas through a passageway 516 and out a nozzle 518. Preferably, a plurality of vanes 520 extend from the outer peripheral surface of the sleeve 68 to form a turbine-like fluid motor and the nozzle directs the pumped gas at an oblique or circumferential direction against these vanes. This gas jet causes the sleeve 68 to rotate and thereby substantially reduce or close the passage through the ports 82 and 86, consequently maximizing the power transferred from the displacer to the piston and thus minimizing or limiting the piston displacement.

While certain preferred embodiments of the present invention have been disclosed in detail, it is to be understood that various modifications may be adopted without departing from the spirit of the invention or scope of the following claims.

I claim:

1. A method for controlling the amplitude of oscillation of a free piston, Stirling cycle, thermomechanical transducer having a displacer and a piston which reciprocate in periodic cycles, the method comprising:

coupling more power from the displacer to the power piston when the piston displacement exceeds a selected displacement limit which is spaced from a central position of the piston's reciprocation path and coupling less power from the displacer to the power piston when the piston displacement is less than the selected limit.

2. A method in accordance with claim 1 wherein said less power is essentially zero.

3. A method in accordance with claim 1 further comprising controllably adjusting the spacing of said limit from said central position to adjust the stroke of the piston.

4. A method in accordance with claim 3 wherein there are two of said limits spaced on opposite sides of said central position and both are adjusted.

5. A method in accordance with claim 3 wherein the spacing of said limit from said central position is controllably varied as a decreasing function of the voltage of an alternator driven by said Stirling transducer to provide voltage regulation.

6. A method in accordance with claim 3 wherein the spacing of said limit from said central position is controllably varied as a decreasing function of piston amplitude of oscillation.

7. A method in accordance with claim 3 wherein the spacing of said limit from said central position is controllably varied as a decreasing function of the pressure of a working gas acting upon the displacer and piston.

8. An improved, free piston, Stirling cycle, thermomechanical transducer having a displacer and a power piston reciprocating within a housing in periodic cycles, the improvement comprising a variable work transmitting linkage mechanically coupling the displacer to the power piston and a switch connected to the linkage for varying the power transmitted from the displacer through the linkage to the piston.

9. A transducer in accordance with claim 8 wherein the switch is coupled to the piston for switching the work transmitting linkage to different work transmission rates in response to piston position, the switch coupled to switch the linkage to a lessor work transmission rate for piston displacement less than a selected displacement limit spaced from the central position of the piston's path of reciprocation and to a greater work transmission rate for piston displacement exceeding said limit.

10. A transducer in accordance with claim 9 wherein the work transmitting linkage is a damper and the switch switches the damping constant of the damper between different damping constant values.

11. A transducer in accordance with claim 10 wherein the position of said displacement limit is variable.

12. A transducer in accordance with claim 9 wherein said displacement limit is variable.

13. A transducer in accordance with claim 12 wherein the displacement limit is varied by the motion of a movable body and wherein the transducer further includes a fail safe mechanism comprising:

(a) a fluid pump linked to the piston for actuation by piston displacement exceeding a fail safe displacement; and (b) a nozzle connected in communication with the pump and oriented to direct fluid from the pump against said body to urge the body toward a reduced displacement limit.

14. A transducer in accordance with claim 9 wherein the work transmitting linkage is a spring and the switch switches the spring constant of the spring between different spring constant values.

15. A transducer in accordance with claim 14 wherein the switch switches the spring between a substantially zero spring constant and a selected finite spring constant.

16. A transducer in accordance with claim 15 wherein the spring is a gas spring and the switch is a valve for alternatively opening to vent the spring gas through a port when the piston displacement is less than said limit and closing the port and closing said port when said piston displacement is beyond said limit.

17. A transducer in accordance with claim 16 wherein the valve is a spool valve having a central slide member and an outer sleeve member and wherein one of the members is linked to the housing and the other member is linked to the piston for alternatively opening the valve to vent the spring when the power piston is less than said limit and closing said valve when the piston displacement exceeds said limit.

18. A transducer in accordance with claim 17 wherein said members have cooperating ports which open the valve when in registration.

19. A transducer in accordance with claim 18 wherein said ports having a triangular configuration with a base of each aligned parallel to a sliding axis of the valve and the apexes opposite said bases pointing in circumferentially opposite directions.

20. A transducer in accordance with claim 19 wherein one of said members is rotatable about said axis for varying the translation interval during which the triangular ports are in registration and thereby varying the position of said limit of the power piston displacement during which the valve is open to vent the gas spring.

21. A transducer in accordance with claim 14 wherein the spring is a magnetic spring including an armature winding and a magnet and the switch is an electrical switch for alternatively opening a circuit from a source of electrical power to the armature winding and closing the circuit.

* * * * *